US006461214B1

(12) United States Patent
Lynch

(10) Patent No.: US 6,461,214 B1
(45) Date of Patent: Oct. 8, 2002

(54) APPARATUS FOR SATISFYING THE NON-NUTRITIVE, ORAL-MOTOR SUCKING NEEDS OF INFANTS

(76) Inventor: Therese Anthony Lynch, 410 Evesham Dr., Baltimore, MD (US) 21212

( * ) Notice: Subject to any disclaimer, the term of this patent is extended or adjusted under 35 U.S.C. 154(b) by 0 days.

(21) Appl. No.: 09/909,821

(22) Filed: Jul. 23, 2001

Related U.S. Application Data

(63) Continuation-in-part of application No. 09/436,643, filed on Nov. 9, 1999, now Pat. No. 6,299,501.

(51) Int. Cl.[7] ..... A63H 3/00

(52) U.S. Cl. ..... 446/73; 446/227; 446/390; 606/234

(58) Field of Search ..... 446/390, 376, 446/304, 385, 227, 71, 72, 73; 606/234, 235, 236

(56) References Cited

U.S. PATENT DOCUMENTS 5,290,198 A * 3/1994 Nakayama ..... 446/297
6,200,192 B1 * 3/2001 Hou ..... 446/352
6,299,501 B1 * 10/2001 Lynch ..... 446/227

* cited by examiner

*Primary Examiner*—Jacob K. Ackun
(74) *Attorney, Agent, or Firm*—Thomas E. Lynch

(57) ABSTRACT

An apparatus for satisfying the non-nutritive sucking needs of infants, especially medically compromised infants, which includes an infant's pacifier held near one end of a wand-like structure; wherein the wand-like structure is formed on a non-toxic, non-allergenic, elastomeric material which is easily cleaned and will not harbor infectious germs or viruses, and wherein the wand-like structure can take the form of an adorable toy animal such as an otter.

18 Claims, 6 Drawing Sheets

APPARATUS FOR SATISFYING THE NON-NUTRITIVE, ORAL-MOTOR SUCKING NEEDS OF INFANTS

This application is a continuation-in-part of Ser. No. 09/436,643, filed Nov. 9, 1999, now U.S. Pat. No. 6,299,501.

BACKGROUND OF THE INVENTION

1. Field of Invention

The present invention pertains to a unique, wand-type holder or tool for securely supporting an infant's pacifier in use, while at the same time providing an easy to grasp extension wand as part of the holder for enabling the infant to reinforce his/her grasping skills. My pacifier holder further provides a consistent perioral stimulation, and enhances the infant's ability to control and keep the pacifier in his/her mouth for independent sucking. More particularly, my unique invention holds or fixes the pacifier near one end of the wand, and enables the infant to grasp, manipulate, and cuddle the wand along its extended length. Thus, my invention permits the infant to safely hold and manipulate the pacifier within his/her mouth by grasping and manipulating the extension wand. Moreover, by grasping and manipulating the extension wand, the infant is able to reinsert the pacifier nipple should it fall from or be removed from his/her mouth. Therefore, my invention facilitates the infant's non-nutritive sucking skills, while at the same time exercising and enhancing the infant's grasping and motor skills. Accordingly, my invention also satisfies the infant's need for physiological stability.

As compared with the prior art, my invention performs all of these functions with a safe, hygienic, low cost, and simple construction.

My invention is also unique because it enhances the nonnutritive sucking of infants, especially medically compromised infants who may experience oral-motor difficulties. Because conventional pacifiers easily fall from such an infant's mouth, and are difficult or impossible to retrieve by the infant, their use by medically compromised infants is often difficult. Thus, conventional pacifiers increase the medically compromised infant's frustration, rather than satisfying his/her physiological needs which is supposed to be the function of a pacifier.

My invention is further novel because it also benefits healthy infants and young children, even after the need for a pacifier is no longer required. This is so because it has the shape of an adorable and engaging animal toy, along with its ability to securely hold the pacifier. Moreover, after the infant has matured to the point where the need for a pacifier has passed, certain embodiments of my invention include a unique overlapping tab-flap holder for the pacifier which can also be used as the loosely flapping arms or flippers for the animal toy.

The unique overlapping tab-flap pacifier holder also functions to hold a variety of different sizes and shapes of pacifiers. The present apparatus includes several further embodiments as compared with my parent apparatus, whereby the number of types and variety of pacifiers that can be accommodated is substantially enhanced. Moreover, some embodiments of my invention facilitate the easy interchanging of pacifiers, of the same or different type, so that a fresh and hygienically clean pacifier can always be made available to the infant, and different types of pacifiers can be used dependent on the infant's needs. This is especially important in a hospital environment where infection control and safety are of utmost importance, and where different infant's needs can vary widely.

When using the overlapping tab-flap construction of some of the embodiments of my invention, it securely holds the pacifier near one end of the extended wand so that neither the pacifier nor the tab-flap construction itself can be easily worked loose by the infant in use. Thus, my holder replaces the hand made, jerry built, prior art pacifier holders which usually rely on medical or Scotch R tape to hold the pacifier to a rolled towel as the holder. The use of a rolled towel and tape to hold the pacifier is unsanitary, and the tape may easily pull loose to represent a choking hazard. My device, on the other hand, is not only effective, it is hygienic and will not easily pull apart to form a choking hazard.

In certain embodiments, the pacifier nipple can be actually molded as part of the holder, which is also inexpensive, hygienic and strongly resists pulling apart.

Further, each embodiment of my invention is of a simple construction so that its cost of manufacture is greatly reduced as compared with other patented versions of the prior art.

My invention is manufactured from a non-allergenic, nontoxic, elastomeric material which has a soft texture, and it is flexible, long-wearing, scuff resistant, heat resistant and inexpensive. As such, my invention is also easily cleaned and sanitized by any number of techniques. For example, my invention can be sterilized in hot water, by alcohol, other disinfectants, it can be manually washed with conventional soap and water, or it can be washed with any kitchen or laundry detergent. Moreover, my invention can also be easily cleaned automatically in a dishwasher. Alternatively, my invention can be cleaned in a laundry washing machine. Thus, my invention can be cleaned and sanitized either with the dishes or with the laundry. Finally, some embodiments of my invention can also be cleaned and sterilized in many of the sterilizing machines typically used in hospital environments.

2. Discussion of the Background of the Invention

As pointed out in great detail in my parent application, which is hereby incorporated by reference, for many years the use of pacifiers has been commonplace to soothe restless infants and to satisfy their non-nutritive sucking needs. Pacifiers take several general shapes and constructions. Thus, commercial pacifiers may include different sizes and shapes for the nipple, they may have a multi-part construction, they may be of one-piece construction, they may come with or without a handle, they may have several different types of handles, or they may have different shapes for the annular flange or shield. Pacifiers are also provided with an annular flange or shield to prevent the infant from sucking the nipple too far into his/her mouth.

Whether to use a pacifier has been at times a problem for caregivers. For example, over the years pacifiers were sometimes frowned upon by the medical and dental professions who thought that they may be harmful to the developing infant. In fact, some medical professionals, especially those who are strong advocates of breast feeding, consider pacifiers to be an "abomination." See, Reisser et al. (Reisser), "*COMPLETE BOOK OF BABY@ CHILD CARE*," Tyndale House Publishers, Inc., Wheaton, Ill., 1997, page 138. Another baby book states: "Some doctors think that constant use of a pacifier can affect a child's ability to make sounds and talk." This book further states: "Many doctors recommend orthodontic-type pacifiers to minimize possible tooth-alignment problems in the future." See, "*AMERICAN MEDICAL ASSOCIATION COMPLETE*

*GUIDE TO YOUR CHILDREN'S HEALTH*," Traisman et al. (Traisman), Random House, New York, N.Y., 1992, pages 40–41. Other doctors maintain that putting a baby to bed with a pacifier should be minimized. They assert: "A pacifier may interfere with your child's ability to develop his or her own self-comforting techniques and the child could wake up when the pacifier falls out of his or her mouth." See, Traisman, supra, page 57.

These professionals apparently assume that only nutritive sucking is healthy for the proper perioral and physiological development of infants. Thus, they assert that non-nutritive sucking devices are not only unnecessary, but may even cause problems for the developing infant. However, most of the medical profession, parents and caregivers have now found pacifiers to be invaluable in practice. This is because the non-nutritive sucking needs of an infant have proven to be very important to the developing infant who needs the consistent perioral stimulation and the physiological satisfaction that is provided by a pacifier. Thus, for example, even infants in the womb have been shown by sonograms sucking their thumbs. Moreover, later during teething, infants also benefit from the use of a pacifier because the their sore gums can be soothed by a pacifier. Furthermore, pacifiers provide a more sanitary and satisfactory alternative to thumb sucking, which is usually thought of as an unsanitary, nasty and hard to break habit. Therefore, pacifiers are have proven beneficial in the proper oral development of the infant over an extended portion of the infant's growth, and are more sanitary as well. Accordingly, the use of pacifiers has expanded in the past several years.

Despite their benefits, for very young infants or medically compromised infants, pacifiers are often difficult to use in practice because, as noted by Traisman, suDra, page 57, they may fall out of the very young or the medically compromised infant's mouth and are not easily retrieved by the infant. This is because the grasping skills of such infants have not advanced fully. Thus, when such an infant yawns or doses off, the pacifier may fall out of his/her mouth. Once the pacifier falls out of the infant's mouth, he/she may awaken with a start and become frustrated and fussy until the pacifier is reinserted by the parent or caregiver. Since the time of parents and caregivers may be limited, the constant reinserting of the pacifier into the infant's mouth has proven to be a difficult problem. Therefore, over the years, there have been several proposed solutions to this problem. Many of these proposed solutions do not appear practical. Nevertheless, some worthwhile solutions have been proposed. The following examples provide several solutions proposed by the prior art.

For example, to simply attach the pacifier with a tether fastened to the infant's garment or around his/her neck is an impractical solution for very young or medically compromised infants. This is so because, even though the fallen pacifier may remain nearby, these infant's grasping skills are such that he/she is incapable of finding the pacifier, much less reinserting it into his/her mouth. More importantly, the use of pacifiers tethers around the infant's neck is frowned upon as a possible threat to the child. See, Reisser, supra, page 138. An example of a tether for attaching a pacifier to the infant's garment is shown in the U.S. Patent to Huber et al. (Huber), U.S. Pat No. 4,903,698, which issued on Feb. 27, 1990.

Other proposed solutions include holding the pacifier in the infant's mouth by tying it into his/her mouth with a strap which snugly fits around the head of the infant. An example of such a pacifier holder is found in the U.S. Patent to Beck, Jr. et al. (Beck), U.S. Pat. No. 2,834,350, which issued on May 13, 1958.

Another variation of the strap solution includes elastic straps around each ear of the infant to securely hold the pacifier in his/her mouth. For example, see the U.S. Patent to Hempstead-Harris, U.S. Pat. No. 4,069,894, which issued on Nov. 13, 1990.

What if the infant no longer wants a pacifier which is strapped into the infant's mouth? He/she cannot just let it fall out of the mouth because the straps prevent this. In Neonatal Intensive Care Units (NICU) and in Pediatric Intensive Care Units (PICU), a partial solution to this problem has been found by jerry building by hand a pacifier holder from rolled towels and tape. Such a solution is depicted in Prior Art FIG. 1(A–B) and FIG. 2. In these Figures, the thickness or thinness of the various components, such as the tape holding everything together, may be exaggerated to facilitate their disclosure.

Prior Art FIG. 1(A) is a top view of such a hand made device. Prior Art FIG. 1(B) is an orthogonal side view of such a hand made device wherein the pacifier (4) is shown extending to the right. Prior Art FIG. 2 is an orthogonal front view of such a hand made device wherein the pacifier (4) is shown extending from the top front of the device. This hand made solution is constructed by tightly rolling and taping via tape (6) a towel (7) to form a wand (1). A tightly rolled cloth diaper might be used as an alternative to the towel (7). Near one end of the tightly rolled towel (7), a pacifier (4) without a handle, is attached with either Scotch® tape or medical tape (23) to hold the annular flange or shield (5) of the pacifier (4) in place. Despite being hand made, such holders have been well-received by medical staffs and therapists because infants and medically compromised children can manipulate the holders themselves. However, these pacifier holders quickly become dirty in use and result in a risk for infection, especially in a hospital setting. Further, the tape (2–3) holding the pacifier to the rolled towel of this type of device can pull loose and present a choking hazard for the infant. Moreover, if the pacifier is not taped near the very top end of the wand, the top edge of the rolled towel may interfere with the breathing of the infant through his/her nose. Of course, when taped near the end of the rolled towel, the tape (2–3) is more easily pulled loose to cause the choking hazard. Accordingly, such problems have prevented a fully endorsed acceptance of these hand made pacifier holders by medical professionals.

There have been other patented devices which perform in a manner comparable to the hand made devices of Prior Art FIGS. 1(A–B) and 2. For example, the U.S. Patent to Ford et al. (Ford), U.S. Pat. No. 5,908,439, issued Jun. 1, 1999, discloses a semi-flexible tube or wand (108) which the infant can grasp. The tube (108) can be hollow and formed of urethane or semi-rigid foam (col. 2, lines 61–65). Alternatively, the tube (108) can be a rolled up diaper (col. 3, lines 41–44). A pacifier (106) is attached at one end of the wand by means of a cloth (100). The pacifier (106) is held at one end of the tube (108) when the cloth (100) is fully wrapped around the tube. A hole (102) is provided at one upper end of the cloth (100), whereby the nipple of the pacifier (106) is allowed to pass through the cloth (100).

To attach Ford's pacifier to the tube requires several manipulative steps: First, the pacifier (106) is held at one end of the tube. Secondly, the nipple of the pacifier is passed through the hole (102) in the cloth (100). Finally, the cloth (100) is rolled around the tube until the VELCRO® fasteners (104) mate, thereby holding the whole unit together. Once assembled and in use, the Ford device is quite similar to the hand made devices of Prior Art FIGS. 1(A–B) and FIG. 2. Thus, Ford's device may become easily dirtied.

Ford's device is also made of a plurality of specialized parts. Moreover, it must be disassembled for cleaning. Once disassembled, one or more of the specialized parts may be lost or misplaced. Further, the assembly of Ford's device does not appear to be easy. Also, if an adhesive is used to hold the pacifier against the tube during assembly, further specialization of the parts may be required.

Another patented device which operates in a manner similar to the hand made Prior Art of FIGS. 1(A–B) and FIG. 2, is found in the reference to Decker et al. (Decker), U.S. Pat. No. 5,665,336, which issued on Jan. 14, 1997. As best shown in FIG. 6, Decker discloses a soft cylindrical pillow (14). Near its top, a horizontal slot (27) is provided in one side of the pillow. The slot (27) allows the handle of a standard, commercial pacifier (36) to be inserted. The pillow (14) also has an elongated hollow aperture (20) through its center. A device (40) is inserted from the top into the aperture (20), through the circular opening in the pacifier handle to hold the pacifier in place. The device (40) is then frictionally held within the aperture to hold the whole assembly together. Finally, an outer cloth cover (24) is elastically fitted over the whole unit. The cloth cover can be removed for cleaning.

In operation as a pacifier holder for infants, Decker's device is quite similar to that of Ford's. Thus, the cloth outer cover might become easily dirtied. Decker's device is also limited to the use of pacifiers with loop-type handles. However, most hospitals do not use pacifiers with such handles. A pacifier without a loop-type handle would simply fall off Decker's device. Also like Ford, Decker's device is made of several specialized parts. Further, the use of a slot in the pillow to insert the handle of the pacifier provides another place where infectious germs may be harbored.

Another example of a wand-type pacifier holder is found in the U.S. Patent to Demeritt et al. (Demeritt), U.S. Pat. No. 5,534,014, which issued on Jul. 9, 1999. Demeritt discloses a pillow pacifier holder formed from a soft foam body (14) with an outer fabric casing (16) which can be washed in a conventional washing machine. The ends of the casing are sewn together over the inner foam member (14). See Col. 3, lines 43–55. A special boss (30) is attached to one side of the pillow where the pacifier is attached. The pacifier has a special end surface glued to it to allow the annular flange or shield of the pacifier to be attached to the pillow. Thus, Demeritt requires a special pacifier, and will not accept pacifiers with handles.

Demeritt is also covered with a cloth fabric which could be easily dirtied. Finally, Demeritt is constructed of several unique parts, especially the special pacifier.

The U.S. Patent to Thomas, U.S. Pat. No. 5,593,336, which issued on Jan. 14, 1997, discloses another wand-type pacifier holder. Rather than a tube-shaped wand as with the other prior art devices above, Thomas discloses a device (10) in which the top portion is bent relative to the bottom portion at an angle indicated by the Greek letter Alpha ($\alpha$). See FIG. 3. The basic structure (10) is either a soft, light-weight cushion or a foam device. Structure (10) is covered with a cloth shell (14). The pacifier is attached at the top end of the device by loops (20–22), which are sewn to the cloth covering. The annular flange of the pacifier is inserted beneath the loops (20–22), which then hold the pacifier to the holder.

It does not appear that the cloth shell (14) of Thomas can be removed for cleaning. Further, the annular flange or shield of the pacifier might work out from under the loops (20–22) in use, and the infant's saliva, milk residue or drool could be trapped within and under the loops. It would further appear that only pacifiers without handles would be usable with the Thomas structure.

The final pertinent prior art reference is the U.S. Patent to Kramer, U.S. Pat. No. 4,188,747, which issued on Feb. 19, 1980. Kramer discloses a pacifier holder in the form of a Teddy Bear, but it can take the form of any other similar animal. See, col. 2, lines 21–30. At the end of the Teddy Bear's nose, a vertical slot or receptacle (15) is provided. The slot (15) receives the round loop handle of a conventional pacifier. The outer edges of the slot are lined with VELCRO® or other adhesive so that they stick together to hold the pacifier handle within the slot after it is inserted. See col. 2, lines 38–56. An alternative embodiment is disclosed in FIGS. 5 and 6. In this alternative, the slot (15) is somewhat smaller than the diameter of the loop handle of the pacifier so that when the handle is inserted, the slot stretches around the handle to hold the pacifier in place.

Kramer is covered with a plush cloth fabric so that it appears to be easily dirtied. The slot (15) might also be difficult to keep clean. Further, Kramer requires pacifiers that have loop-type handles, not like those normally used in hospitals. Kramer also includes several specialized structures.

SUMMARY OF THE INVENTION

It is an object of the present invention to provide an apparatus for holding many types of pacifiers with a wand-type holder, whereby the non-nutritive perioral and physiological sucking needs of infants and young children are satisfied.

It is a further object of the present invention to provide a wand-type apparatus for holding different types of pacifiers, whereby the non-nutritive perioral and physiological sucking needs of very young infants, low weight infants and medically compromised infants are also satisfied.

It is a further object of the present invention wherein the grasping and manipulative motor skills of infants, especially the very young and the medically compromised infants, are enhanced.

It is still further an object of the present invention to provide a flexible wand-type apparatus for holding many types of pacifiers, which takes the form of a extended flexible wand with the pacifier attached near one end of the wand, and wherein the extended portion of the wand can be grasped and manipulated by the infant to enhance the oral-motor skills of the infant.

It is a further object of the present invention wherein the wand-type pacifier holder is formed of a simple construction.

It is a further object of the present invention wherein the wand-type pacifier holder is molded from a non-allergenic, non-toxic, elastomeric material which has a relatively soft texture, but is tough, flexible, long wearing, scuff resistant, heat resistant, easily dyed or colored, easily cleaned, and inexpensive.

It is a further object of the present invention wherein an embodiment of my wand-type pacifier holder includes a tab-flap holder near one end of the wand wherein a portion of the holder fits around the nipple and over the annular flange or shield of a pacifier, and wherein the tab and the flap are locked together when closed to hold the pacifier firmly to the wand.

It is a further object of the present invention wherein an embodiment of my wand-type pacifier holder includes a tab-flap holder near one end of the wand wherein a portion of the holder fits around the nipple and over the annular flange or shield of the pacifier, wherein the tab and the flap are locked together when closed to hold the pacifier firmly to the wand, and wherein the tab and flap are quickly reopened by a caregiver for the removal of a dirty pacifier and the insertion of a fresh, clean pacifier, and which also easily allows the substitution of a different type of pacifier.

It is a further object of the present invention wherein the wand-type pacifier holder is formed of relatively smooth material so that there are few places for harboring dirt or infection.

It is a further object of the present invention wherein the outside surface of the wand-type pacifier holder is formed of relatively smooth molded material so that there are few places for harboring dirt or infection, and wherein the device is easily cleaned and sanitized by a number of convenient methods.

It is a further object of the present invention wherein the wand-type pacifier holder may take the form of an adorable animal figure, such as an otter, which an infant or young child may also use as a toy.

It is a further object of the present invention wherein the wand-type pacifier holder may take the form of an adorable animal figure, such as an otter, which an infant or young child may also use as a toy, and wherein in certain embodiments, the tab and the flap of the pacifier holder may form the forelegs and webbed paws of the otter.

It is a still further object of the present invention wherein the wand-type pacifier holder may take the form of an adorable animal figure such as an otter, which an infant or young child may also use as a toy, and wherein the head of the otter is recessed latterly from the pacifier holder so that it does not interfere with the breathing of the infant through his/her nose.

It is still a further object of the present invention wherein the pacifier holder is adaptable for use with very small infant's pacifiers and with pacifiers of several different shapes and sizes.

It is still a further object of the present invention wherein the pacifier is molded and permanently formed as part of the holder.

BRIEF DESCRIPTION OF THE DRAWINGS

FIGS. 8(A–C) disclose the front, side and back views of another embodiment of my invention wherein the arms are formed of a single extended piece which is attached to the animal figure by an overlapping VELCRO® fastener at the back of the animal figure.

DESCRIPTION OF THE PREFERRED EMBODIMENTS

Figure 2:
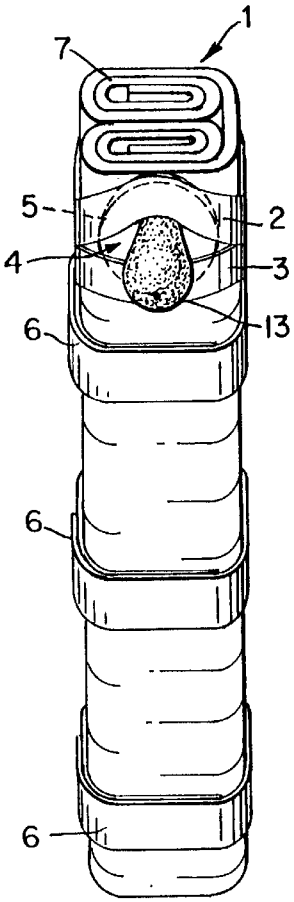
Fig.2 (PRIOR ART)
FIG. 2 is an orthogonal front view of the Prior Art, hand made pacifier holder of FIGS. 1(A–B).

In the following, the present invention will be described in detail in conjunction with the exemplary embodiments thereof with reference to the accompanying drawings. Also, in the drawings, those elements of the invention in the various Figures which are in common, will be referred to by the same numerals.

The first embodiment of my invention is disclosed in FIGS. 3(A–C), 4(A–C), 5(A–B) and 6(A–D), considered collectively. These Figures are directed to the same embodiment of FIGS. 3(A–C), 4(A–C), 5(A–B) and 6(A–D), disclosed and claimed in my copending parent application Ser. No. 09/436,643, filed Nov. 9, 1999. As noted above, the present application is a continuation-in-part of that application, and priority is claimed as to all common subject matter. My invention herein includes all of the detail of my parent application which is hereby incorporated by reference.

Figure 3C:
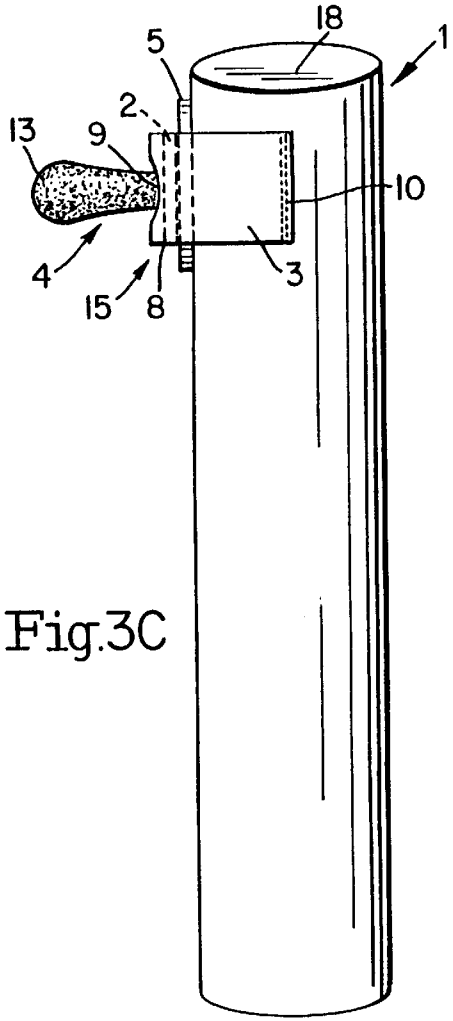
FIG. 3C is the side view of an alternative plain cylindrical embodiment of my invention with a pacifier attached.
Figure 3B:
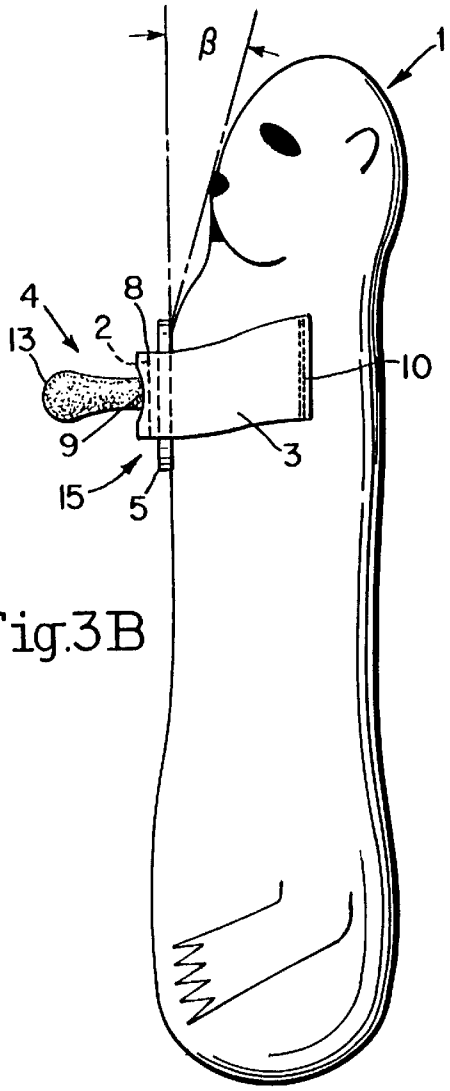
FIGS. 3(A–B) are the front and side views of one otter shaped embodiment of my invention with a pacifier attached.
Figure 3A:
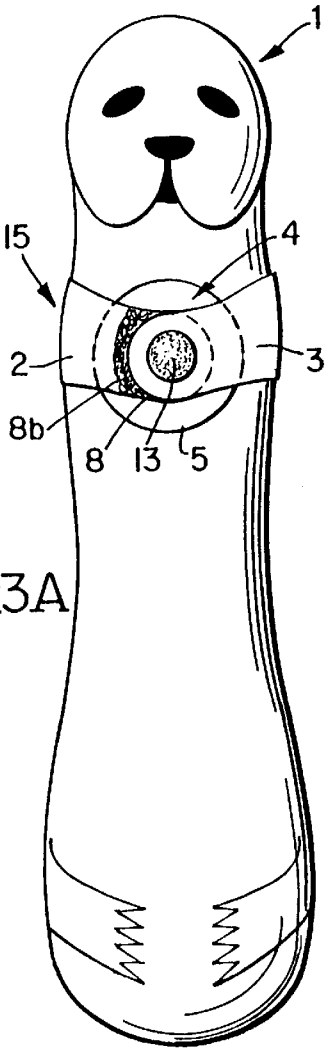

FIG. 3A is a front view of my wand-type pacifier holder (1). FIG. 3B is a side view of the pacifier holder of FIG. 3A. In these Figures, the elongated wand-type pacifier holder (1) takes the form of an adorable animal figure such as an otter. Alternatively, the wand of my holder can be a straight cylinder, such as shown in FIG. 3C, or it can take any other convenient cross sectional shape, as desired.

The pacifier holder (1) of FIGS. 3A and 3B can have an approximate cross section as small as 1 inch in diameter and 6 inches in length, or as large as 2 or 3 inches in diameter and 18 inches in length, dependent upon the size required for the particular infant. Any convenient elastomeric material can be utilized in molding the holder (1), provided that it is non-toxic and non-allergenic in nature. Further it must be sufficiently soft, resilient and flexible so that it can be flexed by the infant, but it will invariably return to its original shape when the infant's grip is relaxed. The outer surface of the holder (1) must be generally smooth and non-porus so as to minimize the retention of dirt and germs. The outer surface of the holder (1) must also be scuff resistant so that it will wear well in use. The holder (1) must also be sufficiently heat resistant such that it will retain its structural integrity when sanitized in hot water. Some embodiments may even be sanitized in steam. The material used in molding the holder (1) must also be non-soluble to cleaning agents such as water, soaps, detergents, alcohol, other disinfectants, etc.

The holder (1) can be a solid material, a hollow structure, or a foam structure. Any coloring of the holder can be molded into the holder (1) at manufacture or may be added externally after the holder is manufactured. Any dyes, pigments, stains or paints used to color the holder (1) must also meet the above qualifications. Any materials painted or coloring the surface of the holder (1) must bind tightly to the molded surface during normal usage over its expected lifetime.

The upper forefeet and webbed paws of the otter of the embodiment of FIGS. 3A and 3B take the form of a tab (2) and a flap (3), which together form the tab-flap holder (15) for the pacifier (4). The thickness of the tab (2) and the flap (3) may be exaggerated in all of the Figures, so that their overlapping function is more readily seen. The actual thickness of the tab (2) and the flap (3) depends on the tensile and flexural strength of the material chosen to mold the holder (1). The thickness of these elements is chosen so that they are sufficiently strong and flexible for the intended life of the holder (1), and so that they do not interfere with the nipple extension of the pacifier. Thus, the tab (2) and the flap (3) must not be so thick that they interfere with the proper function of the pacifier nipple (13), especially with very small pacifiers.

This embodiment of my invention is intended to be used with pacifiers that do not have a handle. Thus, the pacifier (4) of FIGS. 3A, 3B and 3C includes the standard flat annular flange or shield (5) and a nipple (13). The nipple (13) can be formed in one piece with the annular flange or shield (5) to make a one-piece pacifier (4), or the pacifier can be of multiple parts which are adhered together.

Figure 4A:
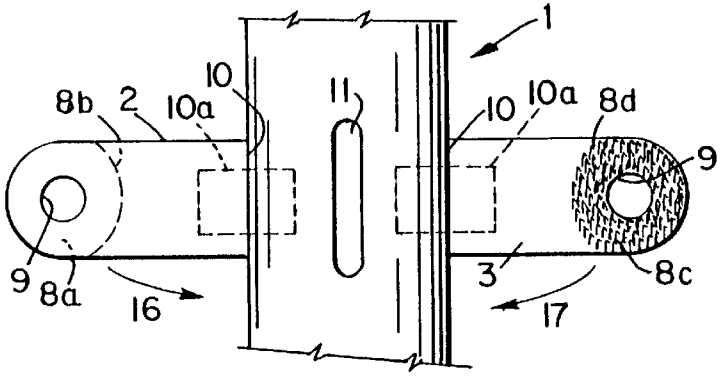
FIG. 4A is a partial view of the front of the embodiments of FIGS. 3(A–C) with the tab-flap pacifier holder opened, and the pacifier removed.

Both the tab (2) and the flap (3) of the holder of my first embodiment include an enlarged hole (9) which is large enough to fit over and around any sized nipple (13) when the tab-flap holder (15) is closed over the pacifier flange or shield (5). The tab (2) is first bent over the pacifier's nipple (13) with the nipple (13) passing through the enlarged hole (9). Then the flap (3) is bent over the tab (2) again with the nipple (13) passing through its enlarged hole (9). The tab-flap holder (15) is then locked in place around the nipple (13), and over the annular flange or shield (5) of the pacifier, by use of a hook and loop VELCRO® fastener (8a) as best shown in FIG. 3B and FIG. 4A. Other convenient fasteners which are known in the art, for example, a snap fastener, a hook and eye fastener, other forms of loop and hook fasteners, a buckle fastener, a clasp fastener, or even a button fastener, etc., might be alternatively used in place of the hook and loop VELCRO® fastener (8). Thus, this embodiment is broadly intended to embrace any other convenient fastener as well.

As disclosed in FIG. 4A, the tab (2) and the flap (3) of the tab-flap holder (15) are shown opened, i.e., before the pacifier is held by the device. In FIG. 4A, the opened tab (2) has a hook and loop VELCRO® material (8*a*) molded into and on the surface facing inwardly in the drawing. The hook or loop VELCRO® material (8*a*) is molded into and on this inwardly facing surface around the enlarged hole (9) at least to the extent indicated by the dotted line (8*b*). Other shapes for the hook or loop VELCR® material (8*a*) are contemplated within the broad teachings of this invention as long as there is sufficient overlap with the mating surfaces to assure proper fastening.

Similarly, as also disclosed in FIG. 4A, the opposite hook or loop VELCRO® fastening material (8*c*) is molded into and on the opened flap (3) surface which faces outwardly in the drawing around its enlarged hole (9) at least to the extent indicated by line (8*d*). Other shapes for this fastening material (8*c*) are also embraced within my invention. Also, rather than being molded into the surface of the tab (2) and flap (3), the hook and loop VELCRO® materials can be alternatively adhered to the mating surfaces of the tab (2) and the flap (3) by adhesives such as glue, etc.

The detailed operation of this embodiment of my invention is best shown in FIGS. 4A and 3A, as follows. First, the flat side of annular flange or shield (5) of a pacifier (4) without a handle, is placed against the front surface of the holder (1). Thereafter, the tab (2) is bent over the nipple (13), and against the outer surface of the annular flange or shield (5) as indicated by the arrow (16) in FIG. 4A. Since tab (2) includes an enlarged hole (9), the pacifier nipple (13) easily passes through that enlarged hole (9) as the tab (2) is bent over the pacifier.

With the tab (2) fitting snugly around the nipple (13) and over the annular flange or shield (5), its hook or loop VELCRO® surface (8*a*) now faces outwardly. Thereafter, the flap (3) is similarly bent over the pacifier as indicated by the arrow (17) in FIG. 4A. Again, the nipple (13) of the pacifier easily passes through the enlarged hole (9) of the flap (3) as it is bent over the pacifier (4). The hook or loop VELCRO® surface (8*c*) of the flap (3) locks with the mating surface (8*a*) of the tab (2), and securely holds the pacifier (4) to the wand holder (1). This is best shown in this embodiment of my invention in FIGS. 3(A–C).

Of course, in this embodiment, the tab-flap holder (15) can be easily opened to remove or change a dirty pacifier (4), simply by pulling the mating surfaces of the hook and loop VELCRO® fastener apart to free the pacifier. While not necessarily required, it may be desirable to aid in the freeing of the pacifier from the holder (1) when the fastener is opened by including a moderate opening bias within the tab (2) and the flap (3) which causes them to move to their normally open positions (shown in FIG. 4A) when the fastener is released. This bias could normally be an inherent characteristic of the resilient, elastomeric material from which the device is molded. Finally, the tab (2) and the flap (3) may take other forms or shapes dependent upon the type of fastener which is chosen to lock the unit together. Examples of different types of fasteners are listed above.

In this embodiment of my invention, the mating hook and loop VELCRO® surfaces are molded into and on the tab (2) and the flap (3) surfaces at manufacture so that a simple construction for this embodiment of my device is maintained. In other words, in this embodiment, the tab-flap holder (15) and the mating hook and loop VELCRO® surfaces are molded into the tab (2) and the flap (3) while my device is being manufactured. Thus, it is difficult for the hook and loop VELCRO® surfaces (8*a* and 8*c*) to be separated from the tab (2) or the flap (3) in use. In contrast, if the hook and loop VELCRO® materials are glued on, or adhered to the tab (2) and the flap (3) by other techniques, the hook or loop VELCRO® material may ultimately work loose in use, no matter how good the glue or other adhering technique might be. Nevertheless, this embodiment of my invention is intended to embrace any adhering technique for attaching the hook and loop VELCRO® fastening materials to the tab (2) and the flap (3).

Further, in this embodiment, a continuous lip or lips can be alternatively provided around the edges of the VELCRO® surfaces so that the edges of those surfaces are sealed when fastened to minimize the seepage of saliva, etc., into the VELCRO® surfaces when the tab-flap fastener is closed. Such a continuous lip would further minimize the threat of infection when this embodiment of my device is in use. FIGS. 6(A–D) disclose this variation.

Figure 6A:
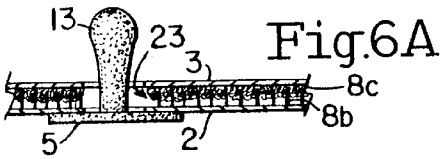
FIG. 6A is an enlarged side view of the pacifier holders of FIGS. 3(A–C), 4(A–C), 7(A–B), 8(A–E) and 9(D–E), wherein no mechanism is provided to minimize the free transmission of salvia, dirt and infection into and through the hook and loop fastener elements when the unit is in use.

FIG. 6A discloses an enlarged side view of the pacifier holders of FIGS. 3(A–C), 4(A–C), 7(A–C), 8(A–E) and 9(D–E) wherein no sealing lips are provided. All of the common elements of these Figures remain the same and will not be further discussed. Without sealing lips around the hook and loop VELCRO® elements 8*b* and 8*c* of the closed fastener, it is clear that the infant's salvia, dirt and possibly infectious material, indicated by the arrow (23), are allowed to freely enter into the nooks and crannies of the fastener elements (8*b*–8*c*) by means of the enlarged hole (9). While this saliva, dirt and possibly infectious material is easily cleaned when the pacifier holder is cleaned, the pacifier holder might be used for an extended time period between cleaning.

FIGS. 6(B–D) show three simple examples for providing lips around the hook and loop fastener elements to minimize the entry of salvia, dirt and infection into the fastener elements during use.

Figure 6B:
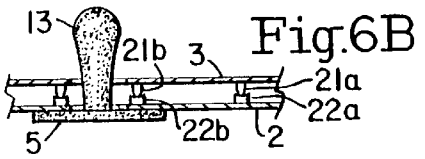
FIG. 6B is an enlarged side view of the pacifier holders of FIGS. 3(A–C), 4(A–C), 7(A–B), 8(A–E) and 9(D–E), with mating lips around the hook and loop fastener elements to minimize the free transmission of salvia, dirt and infection into the fastener elements.

In FIG. 6B, the upper fastener element (3) includes lips (21*a*) and (21*b*) which surround the fastener elements, and have a downwardly directed, generally pointed, cross section. The mating fastener tab element (2) includes upwardly extending lips (22*a*) and (22*b*) which have a cross sectional depression which receives and seals the generally pointed lips (21*a*) and (21*b*) when the fastener is closed. Consequently in use, salvia, dirt and infection are generally blocked from entering into the nooks and crannies of the closed fastener. Since the lips are molded as part of the one-piece construction, they are made of the same flexible and resilient material, so that any misalignments, if they occur, are compensated for in use. Thus, the lips are very effective in sealing the fastener elements from salvia, dirt and infection. Alternatively, the lips could be on the opposite tab-flap surfaces.

Figure 6C:
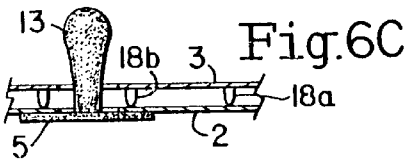
FIG. 6C is an enlarged side view of the pacifier holders of FIGS. 3(A–C), 4(A–C), 7(A–B), 8(A–E) and 9(D–E), with only one lip provided around the hook and loop fastener elements.

In FIG. 6C, only upper lips (18*a*) and (18*b*) are employed. In this embodiment, lips (18*a*) and (18*b*) are of sufficient length, flexibility and resiliency so that an effective seal is achieved between them and the flat surface of tab element (2) when the fastener is closed. Alternatively, the lips (18*a*) and (18*b*) could be on the lower element (2).

Figure 6D:
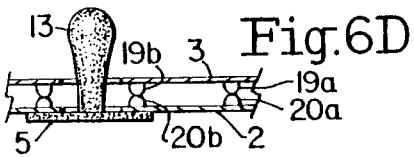
FIG. 6D is and enlarged side view of the pacifier holders of FIGS. 3(A–C), 4(A–C),7(A–B), 8(A–E) and 9(D–E), with similar upper and lower lips provided around the hook and loop fastener elements.

In FIG. 6D, the upper and lower lips (19*a*), (19*b*) and (20*a*), (20*b*), are provided which have the same cross sectional profile. Again however, they are sufficiently flexible and resilient so that when the fastener elements are closed, the lips resiliently abut one another and provide an effective seal against salvia, dirt and infection.

Returning now to the remaining embodiments, FIG. 4A discloses alternative feature of the embodiment or FIGS. 3(A–C). Every time a pacifier (4) is replaced by a different pacifier, the tab (2) and the flap (3) are flexed open and shut. This flexing causes stresses at the joints (10) where the tab (2) and the flap (3) are attached to the body of my holder (1). In this embodiment, the material chosen for molding the body (1), the tab (2), and the flap (3) of my device is such that this constant flexing never causes any problem during the reasonable lifetime of the device. However, depending upon the elastic limit of the flexible material chosen from which my device is molded, it is conceivable that this constant flexing at the bending joints (10) may ultimately cause the tab (2) or the flap (3) to crack or even break loose at the bending joints (10). Accordingly, reenforcing devices or hinges (10*a*) may be molded into the joints (10) so that such cracking or breaking of the flexible material will not allow either the tab (2) or the flap (3) to break loose during the reasonable lifetime of the device. Such reenforcement or hinges (10*a*) are preferably molded within the tab (2), the flap (3), and the body (1) so that my overall unit retains its simple construction. However, the bending reenforcement or hinges (10*a*) may be alternatively glued or adhered by other techniques along the surfaces of the tab (2), the flap (3), and the body (1) of my device. Again, the molding of these devices into the holder is preferred because any glue or adhering technique is more likely to work loose than the molding of the devices (10*a*) within the holder. Nevertheless, this embodiment of my invention is intended to broadly embrace any technique for applying the reenforcement or hinges (10*a*). If convenient, such reenforcement or hinges (10*a*) may also provide the bias discussed above tending to open the tab (2) and the flap (3) after the fastener has been opened.

Figure 4B:
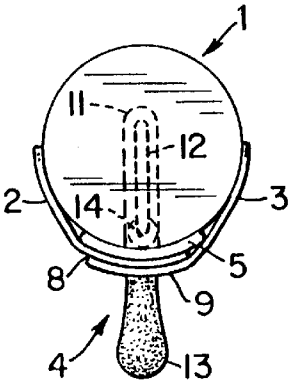
FIG. 4B is a view of FIG. 4A from the top, facing downwardly.

FIG. 4A in combination with FIG. 4B, also discloses another variation of the first embodiment of my invention. As shown in FIG. 4A, an optional vertical slot (11) can be molded into the body (1) of my pacifier holder. FIG. 4B is a view of FIG. 4A as seen from the top with a pacifier (4) installed in the holder (1). In FIG. 4B, the slot (11), shown in phantom line, discloses the extent of the slot (11) into the body (1). The purpose of the slot (11) is to accommodate pacifiers with handles. As I discussed above, pacifiers come in many sizes and shapes. Many times pacifiers are equipped with handles so that older infants can grasp them. Thus, the pacifier (4) shown in FIG. 4B discloses a handle (12) which is conventionally attached to the back of the annular flange (5) by a hinged joint (14). As shown in FIG. 4B, the pacifier handle (12) is allowed to be inserted into the slot (11). Then, the tab (2) and flap (3) can be fastened together around the nipple (13) and against the annular flange (5), to hold the pacifier in place without any interference with the pacifier handle in the same manner as described above. Note that the pacifier flange or shield (5) may be either rigid or somewhat flexible to conform to the body or the tab-flap holder when it is closed.

As discussed above with respect to the prior art reference to Decker and the prior art reference to Kramer, the use of a slot (11) to accommodate pacifiers with handles within the body of a pacifier holder (1) may be undesirable because such slots can also harbor dirt and infectious germs. In my case, such slots should be avoided where possible. Therefore, the preferred manner of using my invention is to use a pacifier that does not have a handle so that the slot (11) is unnecessary. This is the case of the pacifier (4) as shown installed in FIGS. 3A, 3B and 3C. However, if the use of such a slot (11) is deemed necessary it should be vertical, and its inner surface should be preferably rounded and smooth so that it is easily cleaned and drained. Under such conditions, the possibility of harboring dirt and infection in such slots is minimized.

Figure 4C:
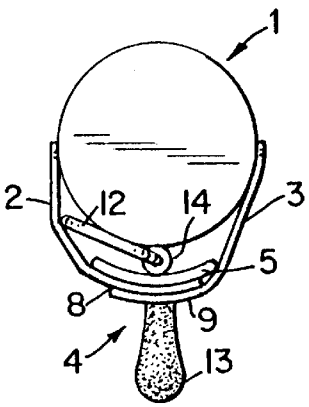
FIG. 4C is an alternative view of FIG. 4A from the top, facing downwardly.

It is also possible to hold a pacifier with a handle with the first embodiment of my holder (1) without providing a slot (11) for the handle. This embodiment is shown in FIG. 4C. Thus, FIG. 4C is a top view of FIG. 4A without the optional slot (11). As shown in FIG. 4*c*, a pacifier (4) with a handle (12) can be accommodated by the first embodiment of my holder even though no slot (11) is provided. Since pacifiers with handles usually have the handle attached to the annular flange (5) with a hinge (14) so that the handle (12) can be pivoted to one side or the other, my device will accommodate such a handle as indicated by FIG. 4C. Here, the handle (12) is shown pivoted to the left with respect to the rest of the pacifier about the hinge (14). Therefore, my preferred embodiment without a slot (11), can also accommodate a pacifier handle as shown in FIG. 4C. In this embodiment, it may be necessary for the lengths of the tab (2) and the flap (3), and the diameter of their enlarged holes (9), to be somewhat larger to accommodate the bulk of the handle. However, even though the lengths of the tab (2) and the flap (3) may be somewhat longer than that required for a pacifier without a handle, and even though the diameter of the enlarged holes (9) may be somewhat larger than that required for a pacifier without a handle, this embodiment will easily accommodate a pacifier either with or without a handle. This is because, when used with a pacifier without a handle, any slack in the tab-flap holder (15) is easily taken up as the flap (3) is tightly fastened over the tab (2).

One further feature of my invention is depicted in FIGS. 4B and 4C. In these Figures, it is noted that the flange or shield (5) is flexible enough so that it is shown deformed to conform with the contour of the tab-flap holder when that holder is closed. However, even if a particular pacifier has a rigid flat flange or shield (5), the lengths of the arms (2) and (3) of the tab-flap holder, and the size of the enlarged hole (9) in these embodiments, are such that such a pacifier is easily accommodated by these embodiments.

There is still another feature of the first embodiment of my invention which is best shown in FIGS. 3B and 3C. Since the pacifier (4) is locked to the holder (1) by the tab-flap holder (15) at the chest level of the otter, the upper chest area and the head of the otter may interfere with the infant's nose, and consequently, the infant's breathing while sucking on the pacifier. Therefore, in my preferred embodiment, the upper chest area and the otter's head are offset latterly to the right as shown in FIG. 3B by an angle shown by the Greek letter Beta (β).

In the variation of my first embodiment shown in FIG. 3C, where the holder (1) takes the form of a straight cylinder, there is no interference problem with the infant's nose because the tab-flap holder (15) is located close to the upper surface (18) of the holder (1).

Figure 1B:
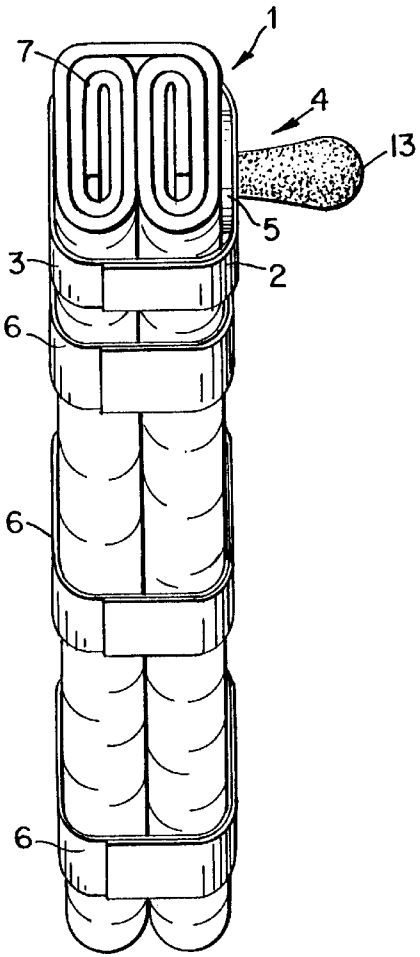
Fig.1B (PRIOR ART)
FIG. 1B is an orthogonal side view of the Prior Art, hand made pacifier holder.
Figure 1A:
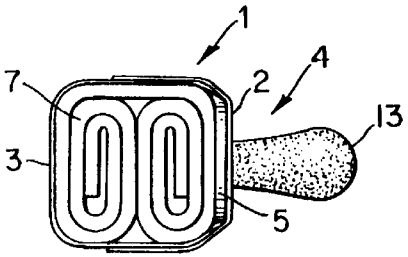
Fig.1A (PRIOR ART)
FIG. 1A is the top view of the Prior Art, hand made pacifier holder.

The variations of my first embodiment shown in FIGS. 3B and 3C should be compared with the jerry built prior art devices of FIGS. 1A, 1B and 2. In the prior art, when the pacifier (4) is taped to the upper edge of the holder (1), the tape segments (2) and (3) may be easily pulled or worked loose causing the choking hazard for the infant described above. Moreover, in the prior art, if the pacifier (4) is taped at a lower point along the holder (1) to avoid pulling loose, the infant's nose would clearly interfere with the upper part of the holder (1) causing a breathing problem when the infant is sucking on the pacifier. Both of these problems are completely obviated by the embodiments of my invention shown in FIGS. 3B and 3C.

Turning now to the further embodiments included in this application, reference is first made to the embodiment of FIGS. 7(A–C). In this embodiment, and in the other embodiments added in this application, the same numbering system used in the previous embodiments will be used in these further embodiments wherever possible. Also, the thickness or thinness of the various components may be exaggerated in these Figures to show the features of the invention.

FIGS. 7(A–C) are directed toward an embodiment similar to the embodiment of FIGS. 3(A–B) as discussed above and in my parent application. This embodiment, however, discloses two further features of my invention.

First of all, this embodiment is mainly directed to the use of my device with pacifiers (4) having small nipple extensions (13), such as those which may be used for very young infants. When a pacifier (4) with a small nipple extension (13) is held with the pacifier holder of FIGS. 3(A–C) and 4(A–C), the thickness of the hook and loop VELCRO® fasteners surrounding the nipple when the fasteners are closed may be such that they mask the nipple extension (13) to such an extent that a portion of the extension of such a nipple is obstructed by the thickness of the fastener elements. This potential obstruction of the nipple extension is indicated in exaggerated manner in FIGS. 6(A–D) by the thickness of the hook and loop fastener elements (8*b*) and (8*c*). In the embodiment of FIGS. 7(A–C), however, the hook and loop VELCRO® elements (8*a*), (8*c*), (8*e*) and (8*f*), are separated laterally to either side of the enlarged holes (9) in the tab (2) and the flap (3), as best shown in FIG. 7B. Now, when this pacifier holder closed, hook or loop element (8*a*) mates with element (8*f*), and element (8*c*) mates with element (8*e*). Nevertheless, this closure is just as effective as the fasteners in the previous embodiments, but the area around the nipple extension is free from the fastener elements. Thus, when the hook and loop VELCRO® fasteners are tightly closed around the curved body of the animal FIG. (1), only the thickness of the tab (2) and the flap (3) are stretched over the pacifier flange or shield (5). However, as further depicted in FIGS. 6(A–D), the thickness of the tab and flap elements (2) and (3), are minimal compared to the thickness of the hook an loop fastener elements. Therefore, the thickness of the closed fastener elements (8*a*), (8*c*), (8*e*) and (8*f*) does not obstruct the nipple extension (13), which may be very important with small nipple extensions.

Moreover, the tab-flap elements of this embodiment include enlarged holes (9) which are shown extended in a lateral direction to accommodate different sizes of pacifiers as the infant grows. Like FIGS. 4B and 4C, described above, this embodiment also works well with pacifiers that have relatively rigid annular flanges or shields (5) which are accommodated by the elongated enlarged holes (9) of this embodiment. Pacifiers with flexible annular flanges or shields (5) also work well with this embodiment because they conform yieldably to the shape of the body (1), as also shown in FIGS. 4B and 4C described above.

Figure 7C:
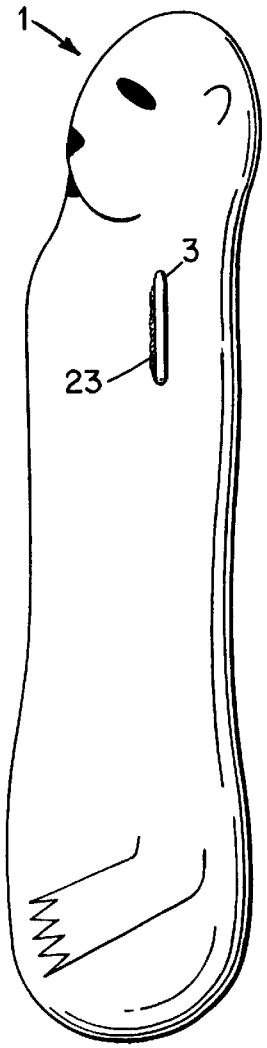
FIG. 7C is a side view of the embodiment of FIG. 7A disclosing an narrow elongated, vertical slot at the shoulder height of the animal figure which extends through the animal figure from one side to the other to accommodate the figure's arms which are formed of a single extended piece.
Figure 7B:
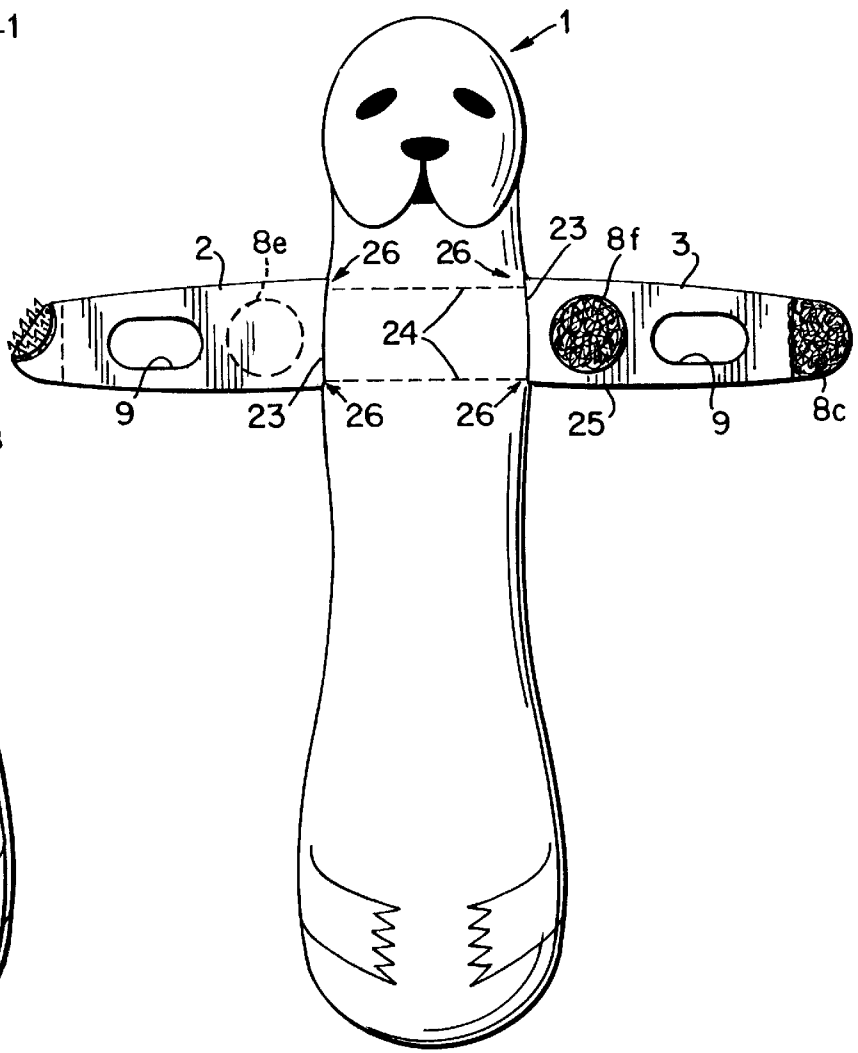
FIG. 7B is a front view of the embodiment of FIG. 7A with the pacifier holder open and the pacifier removed.

FIGS. 7B and 7C disclose a further feature of my invention. In these Figures, the tab and flap elements (2–3) of the holder are made of a single molded piece (25) which is shown by the dotted lines (24) in FIG. 7B extending through the animal FIG. (1). In this embodiment, the single piece (25) is snugly threaded through the body of the animal FIG. (1) by means of the slot (23) shown in the side view of the animal figure in FIG. 7C. This separate piece (25) is used since it has been found to be easier to manufacture then molding, or otherwise adhering, the tab and flap to the. sides of the animal body (1) when the animal body (1) is formed as with the prior embodiments above. The separate piece (25) is not only easier to construct, but it also stronger in use than molding or gluing the tab and flap elements to the sides of the animal figure as in the prior embodiments since there is a reduced stress at the joints (23) when the single piece (25) is installed. Moreover, after the piece (25) is threaded through the animal FIG. (1), it can either be permanently attached to the body of the animal FIG. (1) at the joints (23) by, for example, glue; or it may not be permanently attached so that it can be removed by the user and replaced by a new piece (25), as deemed necessary by the user. Alternatively, the portion (24) of the piece (25) which is threaded through the animal FIG. (1) can be notched, either at the top or the bottom or both as shown by the arrows (26), so that the piece is firmly held within the animal FIG. (1) after it is threaded through the animal figure. The notches (26) can take any appropriate shape dependent on the shape of the animal FIG. (1), and how firmly the piece (25) is to be held within the animal figure. Since the animal FIG. (1) and the piece (25) are formed of resilient material, the threading of the piece (25) through the animal body (1) is not difficult, even though it remains firmly in place after being so threaded. These embodiments can also be applied to the prior embodiments of FIGS. 3(A–C) and 4(A–C), above.

As a further variation of FIGS. 7(A–C), the piece (25) is not threaded through the animal FIG. (1), but extends around the back of the animal FIG. (1) as shown in FIGS. 8(B–C). In this a variation, the piece (25) is either molded to the back of the animal FIG. (1) when the animal FIG. (1) is molded, or the piece (25) can be adhered to the back of the animal FIG. (1) by glue or by a further hook and loop VELCRO® fastener such as (8*h*) shown in FIGS. 8(B–C). As with FIGS. 7(A–C), these embodiments can also be applied to the prior embodiments of FIGS. 3(A–C) and 4(A–C), discussed above.

Figure 7A:
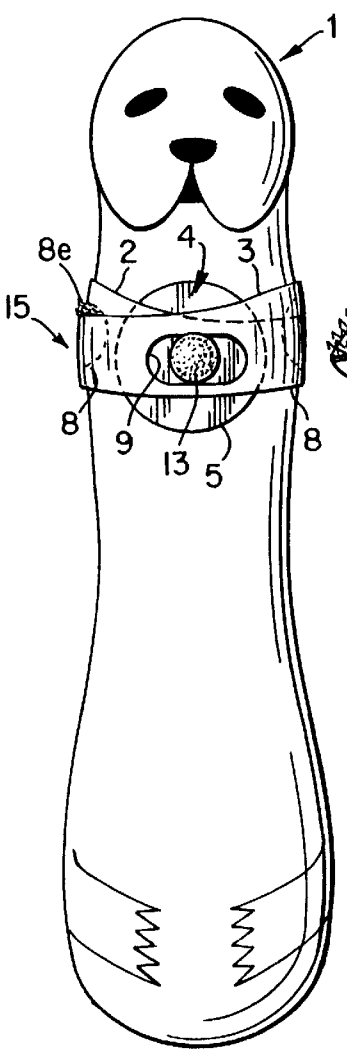
FIG. 7A is a front view of another embodiment of my invention with the pacifier holder closed, which is useful with small pacifiers having small nipple extension.
Figures 8A, 8B, 8C, 8D:
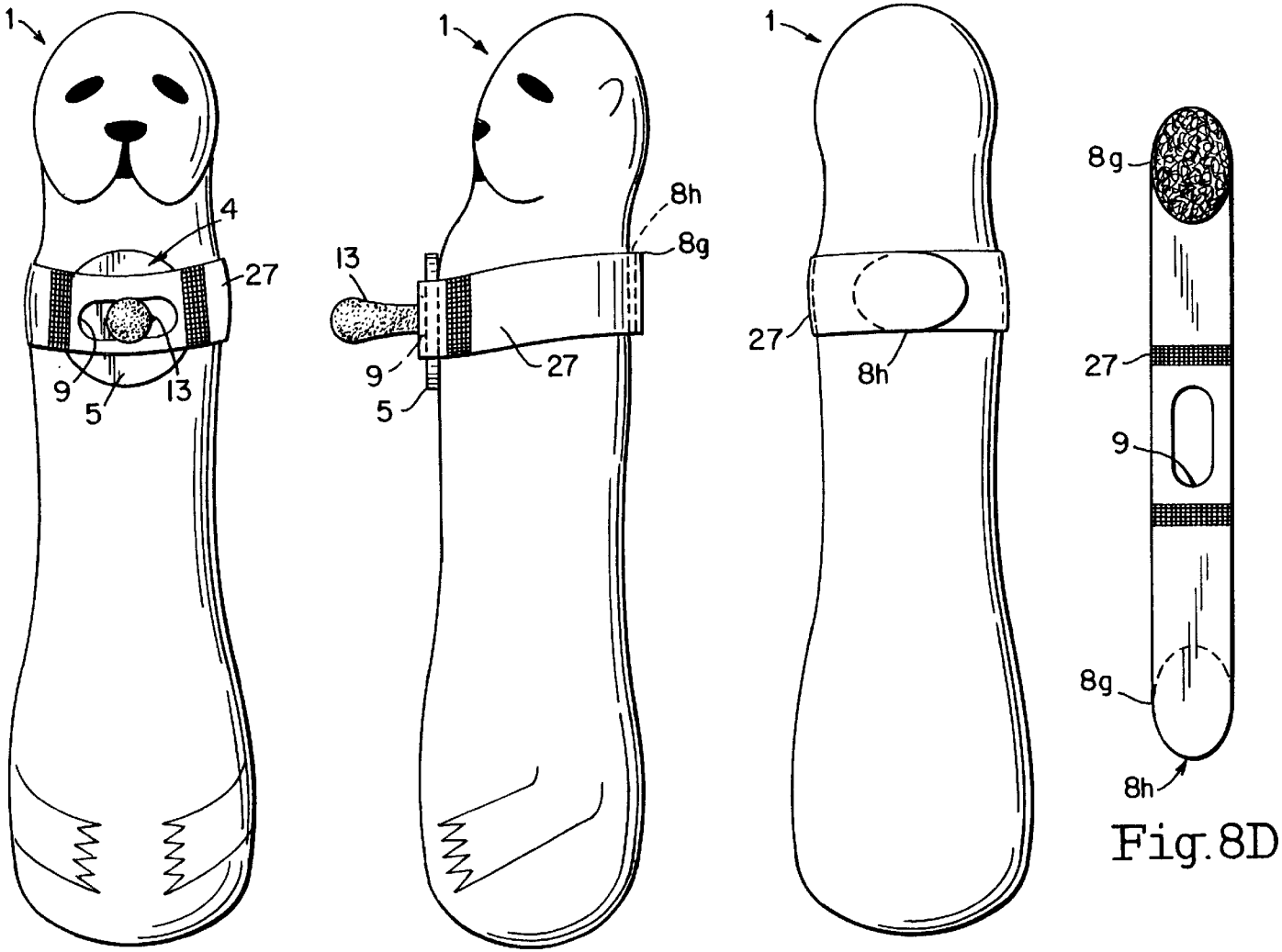
FIG. 8D discloses the arms of FIGS. 8(A–C) formed of a single extended piece.

FIGS. 8(A–D) disclose a further variation of FIGS. 7(A–C), in that it is useful with pacifiers with a small nipple extension (13). In this embodiment, the pacifier holder is formed of a single flat flexible strap (27), as shown laid out flat in FIG. 8(D). A single enlarged hole (9) is also provided in the center of the flat strap (27) so that larger pacifiers may be accommodated as the infant grows. In operation, the strap (27) is placed over the nipple extension (13) through the enlarged hole (9), such as shown in the front and side views of FIGS. 8(A–B). The strap (27) is then tightly wrapped around the animal FIG. (1), and the ends are joined at the back of the animal FIG. (1) by a hook and loop VELCRO® fastener (8*g*). An additional hook and loop VELCRO® fastener (8*h*) is also provided to attach the holder strap (27) to the back of the animal FIG. (1) as shown in FIGS. 8(B–C). This embodiment is useful for small nipple extensions because the pacifier flange or shield (5) is only covered by a single layer, such that the holder obscures the pacifier extension to even a lesser extent than that of the holder of FIG. 7(A). Further, the length of the strap (27) can be of such length, and the enlarged hole (9) of such size, that they are effective whether the pacifier flange or shield (5) is flat and rigid, or flexible and conforming, as with FIGS. 4B and 4C described above. Once again, this embodiment is also applicable the prior embodiments of FIGS. 3(A–C) and 4(A–C), above.

Figure 8E:
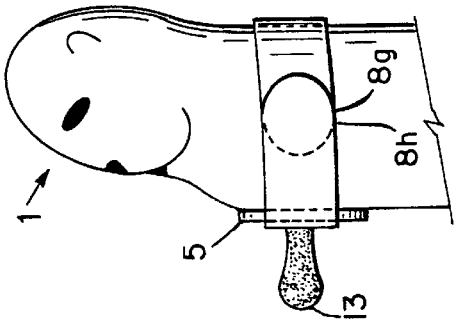
FIG. 8E discloses a side view of an embodiment wherein the holder consists of a single extended piece forming the arms of the animal figure, and wherein the tab-flap fastener is placed at one or the other sides of the animal figure, rather than at or near the front of the animal figure.

FIG. 8(E) discloses a further variation of FIGS. 8(A–D). This embodiment operates in the same manner as that of FIGS. 8(A–D), except that the hook and loop fasteners (8*g*) and (8*h*) are located at one side of the animal FIG. (1), rather than at the back of the animal FIG. (1) as in FIGS. 8(A–D). Of course, the fasteners (8*g*) and (8*h*) could be at the opposite side or at the back or any other appropriate position of the animal figure interchangeably. Also, once again, this embodiment is also applicable to the prior embodiments of FIGS. 3(A–C) and 4(A–C), above.

Turning now to FIGS. 9(A–E), a still further embodiment is disclosed for use with pacifiers having a concave flange or shield (5). As indicated above, pacifiers have evolved over the years. Recently, the flanges or shields (5) have become concave so that they fit more snugly around the mouth of the infant. FIG. 9A discloses an isometric view of such a pacifier. This pacifier may, or may or not, have a handle (12); and the handle (12) may be as simple as a circular knob. The flanges or shields (5) can be rigid or flexible, and they usually have relief holes (28) so that air is allowed to pass freely between the shield and the infant's mouth. If the flanges or shields are flexible, they readily conform to the shape of the animal figure when the holder is closed. Thus, any of the holders of any of the prior embodiments will work with such pacifiers.

Figure 9C:
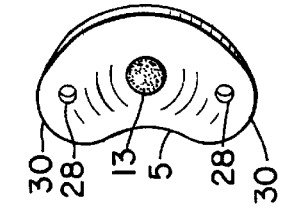
FIGS. 9(A–C) discloses three views of one popular type of type of pacifier, wherein the annular flange or shield of the pacifier is concave, and wherein the handle consists of a simple knob.
FIG. 9D discloses the single extended piece forming the arms of the animal figure which accommodates the concave flange of the pacifier of FIGS. 9(A–C).
FIG. 9E is a cutoff view of the animal figure disclosing the pacifier of FIGS. 9(A–C) installed with the single piece structure of FIG. 9D.
Figure 9B:
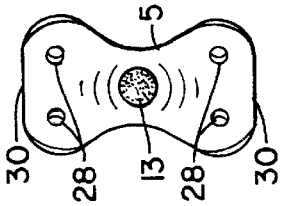
Figure 9A:
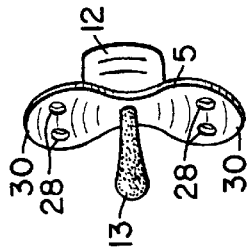

FIGS. 9B and 9C disclose two different front views of the pacifier of FIG. 9A. In each of these views, the flange or shield (5) can take different shapes. In FIG. 9B, the concave flange or shield (5) is horizontally symmetrical about the nipple (13). This version discloses four relief holes (28).

In FIG. 9C, the flange or shield (5) is nonsymmetrical about the nipple to further conform with the mouth of the infant. Also, only two relief holes (28) are disclosed, but four could be used if desired.

When the concave flange or shield (5) is flexible, a strap (27) like that of FIG. 8D, would work equally well with any of the pacifiers of FIGS. 9(A–C). This would be especially so when the pacifier handle (12) is very small, or there is no handle at all. Similarly, the arms (2–3) of the other embodiments described above would also accommodate the pacifiers of FIGS. 9(A–C), especially when the flange or shield (5) is flexible.

Figure 9D:
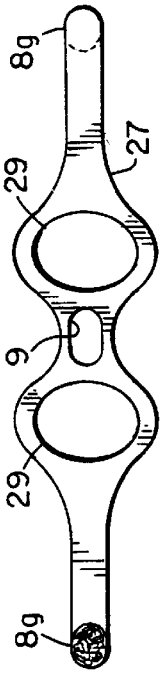

However, when the flange or shield (5) of the pacifiers of FIGS. 9(A–C) are not flexible, a special strap (27) like that shown in FIG. 9D may be required. With this strap (27), enlarged holes (29) are provided so that the rigid concave wings (30) of the flange or shield (5) are allowed to extend through the holes (29) when the holder is closed. Using the strap of FIG. 9D, the enlarged hole (9) still lies flat around the base of the nipple (13), so that the strap of this embodiment does not interfere with the use of this type of pacifier.

Figure 9E:
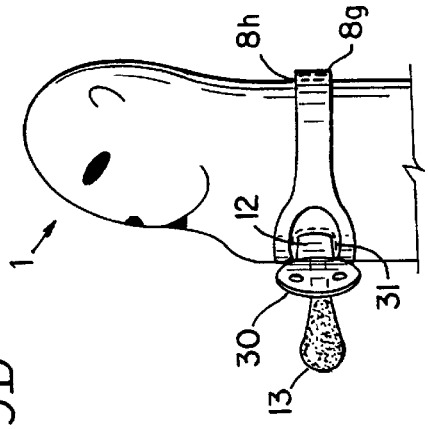

FIG. 9E discloses a cut-off side view of an animal figure with a pacifier holder like that of FIG. 9D. Note that the rigid wings (30) pass through the holes (29) so that the enlarged hole (9) lies flat around the base of the nipple (13). If the pacifier has a knob-like handle (12), it may be necessary to include a recess, shown dotted in the side of the animal figure by the number (31). As with prior embodiments, the recess (31) may take different shapes as necessary to accommodate different shaped handles (12).

Figure 10B:
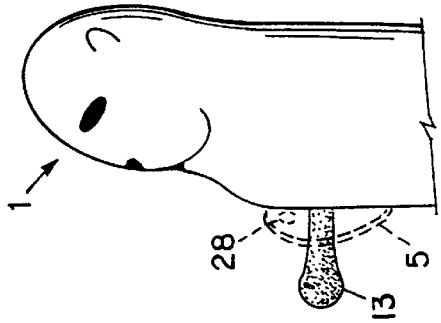
FIG. 10B is a side view of the animal figure of FIG. 10A wherein the nipple of the pacifier is permanently made as part of the animal figure.
Figure 10A:
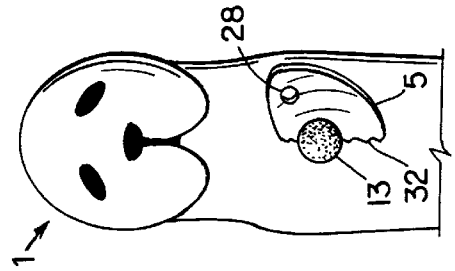
FIG. 10A is a cutoff view of the animal figure wherein the nipple of the pacifier is permanently made as part of the animal figure.

FIGS. 10(A–B) disclose the final embodiment of this invention. In this embodiment, rather than using a separate pacifier, the pacifier is molded as part of the animal FIG. (1) when the unit is manufactured. FIG. 10A discloses the nipple (13) of the pacifier (4) being molded directly out of the chest of the animal FIG. (1). The pacifier (4) may or may not include a flange or shield (5). This is indicated by the cutoff line (32). In other words, a flange or shield (5) may or may not be deemed necessary. When deemed necessary, the flange or shield (5) would be symmetrical about the nipple as in FIG. 9C. When the flange or shield is deemed unnecessary, it would not be molded as part of the animal figure as indicated by the left side of FIG. 10A.

FIG. 10B is a side view of the animal figure of embodiment of FIG. 10A. In this Figure, the optional shield or flange (5) is indicated in dotted line. The embodiment of FIGS. 10(A–B) has several advantages over the other embodiments. First of all, the tab-flap holders of the prior embodiments are eliminated. Secondly, the fastener elements are also eliminated. Thirdly, the unit becomes even simpler and less expensive to manufacture. However, this embodiment retains all of the desirable features of the other embodiments, such as being resistant to infection and dirt, while at the same time being easily cleaned by any of the techniques discussed above.

Figure 5A:
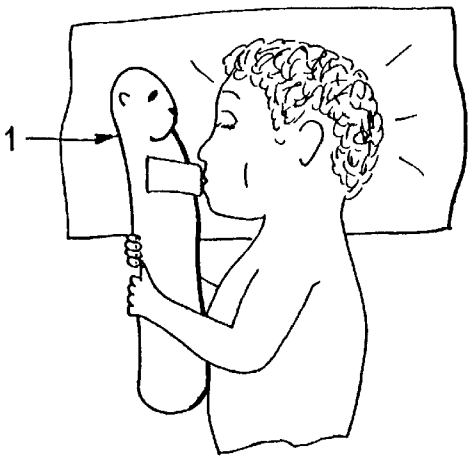
FIG. 5A is a view of the preferred embodiment of my invention in which an infant is grasping the otter-shaped wand and sucking the pacifier.
Figure 5B:
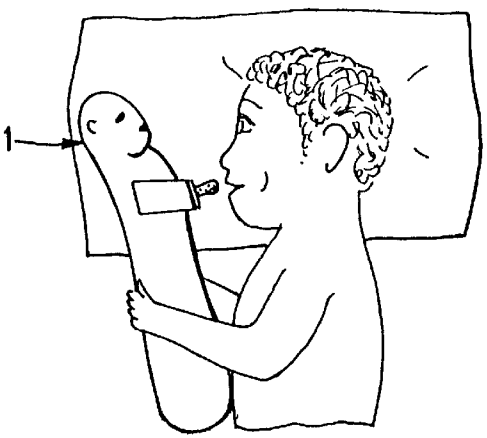
FIG. 5B is a view of the preferred embodiment of my invention in which an infant has let the pacifier fall from his/her mouth, but where the infant is still happily grasping and fondling the pacifier holder as an adorable toy.

Turning now to FIGS. 5A and 5B, the use of my invention is depicted. These Figures are applicable to all embodiments of my invention. FIG. 5A discloses an infant sucking on a pacifier holder (1) in the shape of an otter, such as that disclosed in FIGS. 3A and 3B, and the embodiments of FIGS. 7(A–C), 8(A–E), 9E and 10(A–B). The infant is shown lying on his/her side with the pacifier inserted in his/her mouth. The elongated wand (the otters lower body) is in such a position that it can be easily grasped by the infant as shown in this Figure. By grasping the otter's body, the infant soon learns that he/she can manipulate the pacifier within the mouth, thus reenforcing his/her grasping skills.

The infant ultimately acquires the ability to adjust the pacifier within his/her mouth by adjusting his/her grasp on the otter's body. This action in turn enhances the perioral action of the pacifier, and the grasping skills of the infant.

Eventually, the infant learns that he/she can remove the pacifier from its mouth, and to reinsert it as desired. These actions greatly benefit the infant's interactive oral-motor capabilities, especially for young infants, and for those infants who are medically compromised.

Finally, as the infant further advances beyond the point where a pacifier is no longer needed, in those embodiments using the tab-flap holder, caregivers can remove the pacifier and leave the tab-flap holder open as in FIG. 4A so that the tab and the flap form the floppy forelegs of the adorable toy animal. Thus, my invention is further capable of being used by the maturing infant simply as a play toy. The grasping skills of infants may even advance to the point that they can replace their own pacifiers using the tab-flap holder themselves, such as at nap times.

Without further analysis, the foregoing so fully reveals the gist of the present invention that others can, by applying current knowledge, readily adapt it for various applications. Therefore, such adaptions should, and are intended, to be included within the broad limitations of the appended claims.

I claim:

1. An apparatus for satisfying the non-nutritive, oral-motor sucking needs of infants comprising:

(a) a one-piece, generally cylindrical, elongated body of flexible, resilient, non-toxic, non-allergenic elastomeric material;

(b) the outer surface of said one-piece, generally cylindrical, elongated body being soft, smooth, and non-porous, which resists the collection and retention of moisture, infectious material, and dirt;

(c) said outer surface of said one-piece, generally cylindrical, elongated body further comprises a supple, scuff resistant and heat resistant material;

(d) said one-piece, generally cylindrical, elongated body further comprising a length which takes the form of a wand;

(e) an infant's pacifier held near one end of said one-piece, generally cylindrical, elongated body;

(f) said one-piece, generally cylindrical, elongated body taking the form of a long, smooth, adorable toy animal;

(g) a vertical slot extending completely through, from one side to the other side, of said long, smooth, adorable toy animal at its shoulder level, which allows the threading of a removable elongated, flat strap through said long, smooth adorable toy animal, said removable, elongated, flat strap forming a tab-flap pacifier holder when its ends are closed over said infant's pacifier;

(h) whereby said apparatus further has minimal surfaces where infectious germs or viruses can be harbored;

(i) whereby said apparatus does not easily become dirty or harbor infectious material in use, and whereby said apparatus is easily cleaned and disinfected by conventional cleaning apparatus and procedures when it does become dirty or infected; and (j) whereby said apparatus reinforces said infant's grasping skills, provides consistent perioral stimulation, and enhances said infant's ability to control and keep said pacifier in said infant's mouth for independent sucking.

2. The apparatus of claim 1, wherein said infant's pacifier is held at the chest level of said long, smooth, adorable toy animal;

(a) the head and face of said long, smooth, adorable toy animal facing outwardly in the same direction as the nipple of said infant's pacifier;

(b) said head and face being fully above said chest level of said long, smooth, adorable toy animal;

(c) said head and face being laterally offset from the plane of said infant's pacifier, whereby said head and face will not interfere with the breathing of said infants when said apparatus is in use.

3. The apparatus of claim 1, wherein said one-piece, generally cylindrical, elongated body is comprised of molded material.

4. The apparatus of claim 1, wherein said one-piece, generally cylindrical, elongated body is comprised of hollow molded material.

5. The apparatus of claim 1, wherein said one-piece, generally cylindrical, elongated body is comprised of solid molded material.

6. The apparatus of claim 1, wherein said one-piece, generally cylindrical, elongated body is comprised of molded foam material.

7. The apparatus of claim 1, wherein said removable, elongated, flat strap which forms said tab-flap pacifier holder is threaded through, and is held securely, by said one-piece, generally cylindrical, elongated body;

(a) wherein said removable, elongated, flat strap which forms said pacifier holder further comprises an elongated, flat, flexible strap with enlarged holes at both ends of such a diameter that the nipple of said infant's pacifier passes freely therethrough;

(b) wherein said removable, elongated, flat strap further includes an overlapping fastener which holds said pacifier in place.

8. The apparatus of claim 7, wherein said overlapping fastener further comprises portions of densely woven hooks and portions of densely woven loops, which when pressed together firmly close said fastener.

9. The apparatus of claim 8, wherein said portions of densely woven hooks and said portions of said densely woven loops do not impinge upon the area around said enlarged holes when said fastener is closed, wherein said infant's pacifier, with a small nipple extension, is accommodated with minimal interference with said small nipple extension.

10. The apparatus of claim 9, wherein said portions of densely woven hooks and said portions of densely woven loops mate with each other when said tab-flap fastener is closed about the nipple of said pacifier, but are situated laterally to the sides of said nipple, whereby the area around said nipple is free of said portions of said densely woven loops and said portions of densely woven hooks.

11. The apparatus of claim 7, wherein the portion of said removable, elongated, flat strap which is threaded through said vertical slot in said one-piece, generally cylindrical, elongated body is notched, to resiliently but securely hold said removable, elongated, flat strap within said one-piece, generally cylindrical, elongated body;

(a) wherein said elongated flat strap is also formed of strong, resilient, non-toxic material;

(b) wherein said portions of tightly woven hooks and said portions of tightly woven loops forming the fastener elements are strongly adhered to the surfaces of said elongated flat strap; and (c) wherein elongated flat strap is resiliently but securely held within said one-piece, generally cylindrical, elongated body such that it is removable by an adult, but not by said infants.

12. The apparatus of claim 11, wherein, rather than being notched, the elongated flat strap is formed somewhat larger than said vertical slot, such that it is frictionally, but still resiliently and securely held, within said vertical slot.

13. The apparatus of claim 1, wherein said removable, elongated, flat strap which forms said pacifier holder is alternatively, securely attached to the back of said one-piece, generally cylindrical, elongated body, rather than being threaded through said vertical slot; and wherein said enlarged hole for allowing said nipple of said infant's pacifier to pass through is located at near the middle of said elongated, flat strap, whereby the area around said nipple extension is free of fastener elements.

14. The apparatus of claim 13, wherein the ends of said elongated flat strap are fastened together by overlapping fastening elements located at the ends of said elongated flat strap, and wherein said elongated flat strap is removably attached to the back of said one-piece, generally cylindrical, elongated body by a further overlapping fastening device.

15. The apparatus of claim 14, wherein said fastening elements are alternatively located at a different location, such as one of the sides, of said one-piece, generally cylindrical, elongated body.

16. The apparatus of claim 13, wherein said infant's pacifier which may have a concave annular flange or shield with winglike concave extensions, is held by a modified elongated, flat strap pacifier holder with laterally displaced openings from either side of said enlarged opening for said nipple extension, wherein said winglike concave projections of said concave annular flange pass through said laterally displaced openings of said modified, elongated, flat strap pacifier holder whereby said modified, elongated, flat strap pacifier holder does not interfere with said nipple extension.

17. The apparatus of claim 1, wherein said infant's pacifier is alternatively held by molding said infant's pacifier nipple as part of said one-piece, generally cylindrical, elongated body, rather than using said removable, elongated, flat strap as said pacifier holder.

18. The apparatus of claim 17, wherein infant's pacifier may include an annular flange or shield which is also molded as part of said one-piece, generally cylindrical, elongated body.

* * * * *